United States Patent [19]

Lahiri

[11] Patent Number: 4,466,422

[45] Date of Patent: Aug. 21, 1984

[54] HUMIDIFIER AND AIR CIRCULATOR

[76] Inventor: Samir C. Lahiri, 244 Old New Rd., Chalfont, Pa. 18946

[21] Appl. No.: 471,889

[22] Filed: Mar. 3, 1983

[51] Int. Cl.[3] ..... F24H 1/00

[52] U.S. Cl. ..... 126/350 B; 126/134; 126/313; 126/388; 237/78 R

[58] Field of Search ..... 126/113, 134, 313, 350 B, 126/388; 219/271, 276, 362; 261/DIG. 65; 239/34, 35, 337; 237/78 R; 73/307

[56] References Cited

U.S. PATENT DOCUMENTS

| | | | |
|---|---|---|---|
| 2,103,844 | 12/1937 | Conley | 219/362 X |
| 4,206,743 | 6/1980 | Niemela | 126/113 X |
| 4,241,719 | 12/1980 | Vickery | 126/134 X |
| 4,294,778 | 10/1981 | DeLuca | 261/DIG. 65 |
| 4,373,506 | 2/1983 | Hyatt | 126/134 X |
| 4,392,478 | 7/1983 | Black | 126/84 |

*Primary Examiner*—Samuel Scott
*Assistant Examiner*—Margaret A. Focarino
*Attorney, Agent, or Firm*—Shlesinger, Fitzsimmons & Shlesinger

[57] ABSTRACT

A sheetmetal water tank has spaced vapor ports in its upper end arranged in a circle. An inverted, generally can-shaped shroud, which has an outer diameter smaller than that of the tank, is secured coaxially on the tank with its lower, open end positioned in spaced, near tangential registry with the vapor ports. An electric fan is mounted in the shroud to rotate in a horizontal plane positioned axially inwardly from the lower, open end of the shroud. The fan is controlled by a combination switch-rheostat unit, which is mounted on top of the shroud for operation by a manually rotatable knob.

In use the tank is placed on a heated surface, and its fan is energized to draw fresh air through vent openings in the top of the shroud, and to force the air radially out of the lower end of the shroud and over the vapor ports so that the air entrains moisture for delivery to the surrounding room. When the water level falls below a predetermined level a float-operated switch in the water tank energizes a warning lamp or neon bulb, which is mounted in an opening in the top of the shroud.

14 Claims, 4 Drawing Figures

HUMIDIFIER AND AIR CIRCULATOR

BACKGROUND OF THE INVENTION

This invention relates to apparatus for increasing the moisture content of air, and more particularly to an improved stove top humidifier having a variable speed fan for circulating moist air.

The furnaces of most domestic heating systems, and particularly those of the warm heating variety, raise the temperature of atmospheric gases, and thus remove moisture from the gases before allowing them to circulate. Dry air having a great affinity for water vapor tends to evaporate skin moisture, and in so doing tends to cool a person's body temperature. The natural result is for one to increase the quantity of heat provided by the system in order to provide greater warmth for the individual. The result is a great consumption of fuel in order to provide the additional heat.

In addition to causing personal discomfort, dry, heated air of the type described causes the drying of membranes in a person's eyes, nose and throat, and long term damage to the skin is evidenced by scaling, itching, roughening and wrinkling. Consequently, dry, heated air not only increases the cost of providing heat, it also introduces a health hazard.

To obviate the above disadvantages it is therefore necessary and desirable to add water vapor to the dry, heated air generated by such heating systems. Humidifiers of the type which have been designed to increase the water content of heated air have generally fallen into two major classes: one known as the pan-type and the other the jet-type. The pan-type utilizes water having a relatively large surface area across which dry, heated air is blown in order to absorb and entrain moisture from the surface of the water. Poor vapor distribution results because of the fact that, as a general rule, the warm air is exposed to the surface of the water for only a brief instant, and therefore cannot entrain much water.

The jet-type humidifier feeds minute droplets of water or steam into the hot air stream, which then absorbs moisture and conveys it to the rooms which are to be warmed. The disadvantage of this type of humidifier is that dissolved salts in the fluid supply will in due course tend to clog the orifices of the jets. Moreover these humidifiers are rather expensive to manufacture and difficult to adjust.

It is therefore an object of this invention to provide an improved humidifier which produces an extremely even distribution of water vapor into the heated air.

Another object of this invention is to provide an improved humidifier of the type described which does not utilize any nozzles for generating water droplets, and consequently eliminates the problem of plugged nozzles.

Still another object of this invention is to provide an improved humidifier of the type described which does not require any connection to an external water supply, and therefore constitutes a self-contained, compact unit which can be employed on countertops, on or near space heaters, or oil, gas or wood stoves, or the like.

Other objects of the invention will be apparent hereinafter from the specification and from the recital of the appended claims, particularly when read in conjunction with the accompanying drawings.

SUMMARY OF THE INVENTION

A variable speed fan is mounted to rotate in an inverted, generally can-shaped shroud, which is secured by brackets coaxially on top of a cylindrically shaped water tank. The lower, open end of the shroud is axially spaced slightly above the top of the tank, which is greater in diameter than the shroud. The fan blades, which rotate in a horizontal plane adjacent the lower, open end of the shroud, and just above the upper end of the tank, draw atmospheric air through an array of holes in the upper end of the shroud, and force the air radially outwardly over a plurality of vapor holes formed in the upper end of the tank adjacent its periphery.

A neon warning lamp, which is mounted in the top of the tank outwardly of the shroud is connected in series with a float-operated switch suspended from the cover of a cleanout opening in the top of the tank. When the water level in the tank falls below a predetermined level the lamp is energized. A knob which projects from the top of the motor shroud is rotatable to turn the motor on and off, and also to adjust its speed. An electric cord for supplying power to the motor is held radially away from the shroud to prevent the cord from lying upon or otherwise touching the heated surface upon which the unit may be mounted such as for example a stove top or the like.

DETAILED DESCRIPTION OF THE PREFERRED EMBODIMENTS

Figure 1:
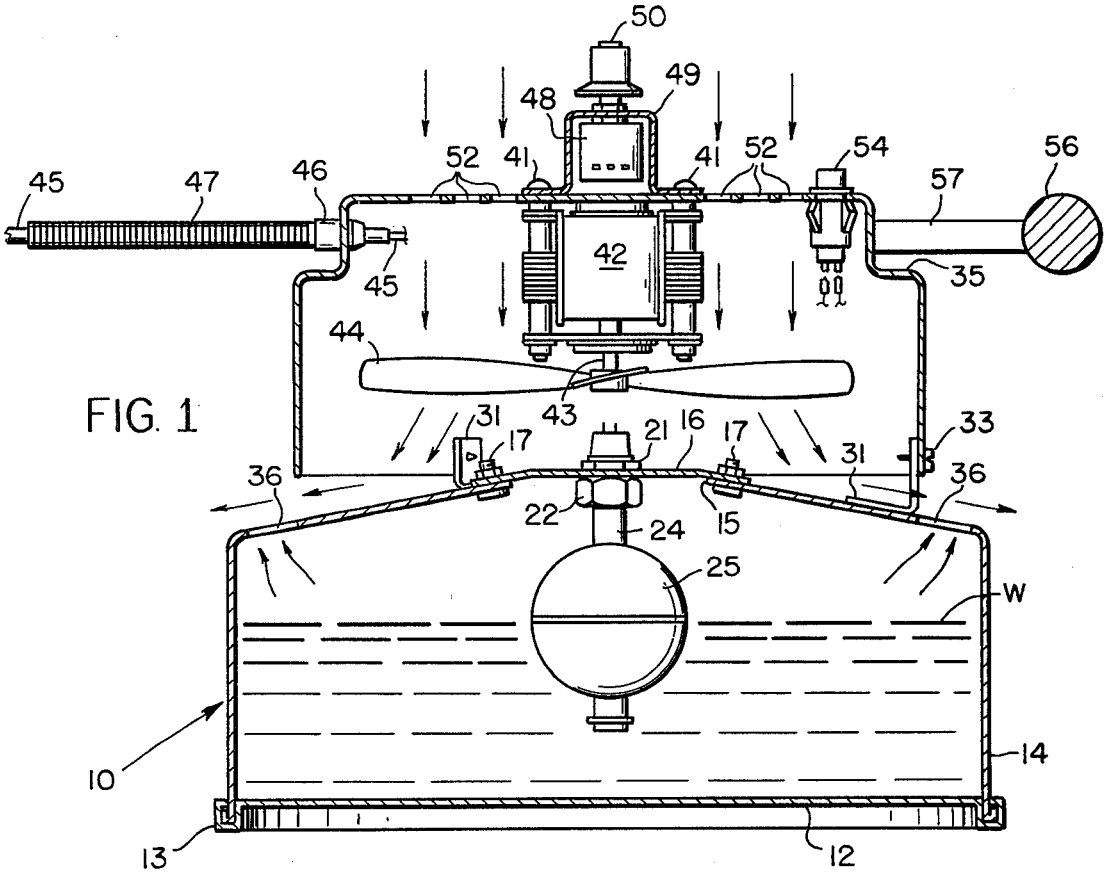
FIG. 1 is a fragmentary sectional view taken generally through the center of an improved humidifier made according to one embodiment of this invention, portions of the humidifier tank and circulating fan being shown in full.
Figure 2:
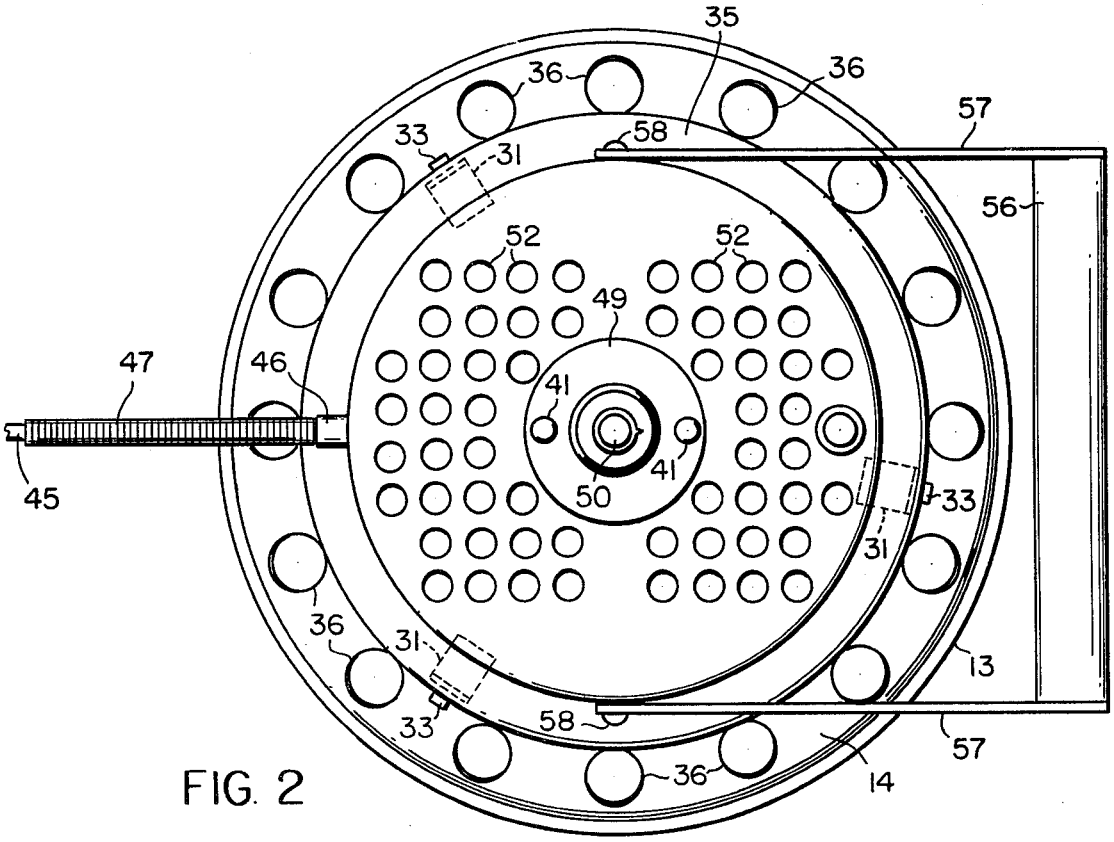
FIG. 2 is a fragmentary plan view of this humidifier.
Figure 3:
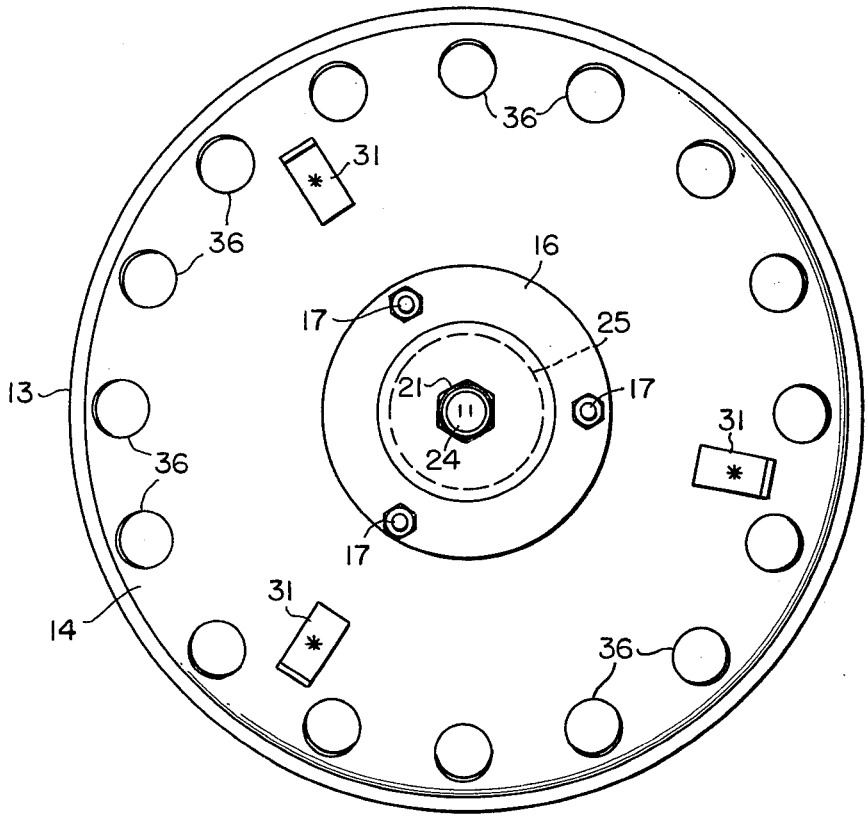
FIG. 3 is also a plan view of the humidifier but with its fan shroud and fan removed from the top of its associated water tank or shell.

Referring now to the drawings by numerals of reference, and first to FIGS. 1 to 3, 10 denotes generally a circular, sheetmetal water tank or boiler comprising a flat bottom wall 12, which is secured around its marginal edges by a rolled, double seamed, water tight joint 13 to the lower end of an inverted, generally cup-shaped casing or shell 14. Shell 14 has in its upper end a centrally disposed cleanout opening 15, which is closed by a cover plate 16 that is removably secured to the shell by a plurality (three in the embodiment illustrated) of conventional nut and bolt combinations 17.

Secured at its upper end in a central bore in the cover plate 16 by a pair of nuts 21 and 22 is the stem 24 of a commercially available magnetic float and reed switch. The stem 24 extends downwardly into shell 14 centrally thereof, and has slidably mounted thereon a float 25. When the tank 10 is filled with water W, the rising level of the water causes the float 25 to move upwardly on the stem 24 to an uppermost position indicative of a properly filled tank. As noted hereinafter, as the level of the water in the tank falls, the float 25 slides downwardly on the stem 24 until it reaches a lowermost position in which it actuates a hermetically sealed reed switch S2 (FIG. 4) which is housed within the stem 24. (Since the above-described float and reed switch combination is conventional, it will not be described in further detail herein.)

Spot welded or otherwise fastened to the upper, outer surface of shell 14 radially inwardly of its peripheral edge are three, equi-angularly spaced brackets 31 (FIGS. 1 and 3), which are nearly right angular in configuration. Each bracket 31 has an upwardly projecting leg which projects into the open, lower end of an inverted, generally cup-shaped shroud 35, the annular wall of which is fastened to the upstanding legs of bracket 31 by conventional self-tapping screws 33. As shown more clearly in FIGS. 1 and 2, the annular wall of shroud 35 has an outside diameter less than that of the shell 14, and has its lower, open end supported by the brackets 31 slightly above and coaxially of the upper, outer surface of shell 14. The lower end of shroud 35 registers nearly tangentially with a plurality of spaced, circular steam or vapor ports 36, which are formed in the upper end of the shell adjacent its outer, circumferential edge, and with their axes lying in a common circle disposed coaxially of the shell.

Fastened by bolts 41 to the underside of shroud 35 coaxially thereof is an electric fan motor 42. The armature shaft 43 of the motor projects downwardly into the center of the shroud 35 and has fastened thereto a fan 44, the blades of which rotate in a horizontal plane which is spaced axially inwardly or upwardly from the lower, open end of shroud 35. Power for the motor 42 is supplied by an electric cord 45, which is secured intermediate its ends in an opening in the annular sidewall of shroud 35 adjacent its upper end by a conventional strain release fitting 46. Cord 45 also passes through a coiled supporting spring 47, which extends some distance outwardly from the outer end of the fitting 46 in order to hold the cord 45 away from the sidewall of the shroud 35 and any heating surface upon which the unit might be mounted.

The speed of motor 42 is controlled by a combination rheostat and ON-OFF switch unit 48, which is mounted on the upper, outer end of the shroud 35 for connection to the windings of motor 42 in a conventional manner. Unit 48 is enclosed within an inverted, generally can-shaped housing 49, which has a flanged lower end secured beneath the heads of the screws 41, which mount the motor 42 beneath the upper end of shroud 35. The operating shaft for the combination rheostat-switch unit 48 projects vertically upwardly through the upper end of the housing 49 and has fastened thereto a manually operable speed control knob 50, which can be rotated to control the rotation of the armature shaft 43, and hence the fan 44.

The upper end of the shroud 35 has formed therein around the outside of the housing 49 a plurality of small, circular vents or ports 52, which permit atmospheric air to enter the shroud 35 when the fan 44 is rotating.

Also mounted in the upper end of the shroud 35 adjacent its outer peripheral edge is a neon warning lamp 54, the purpose of which is noted hereinafter.

For carrying the unit a hand grip or handle 56 is secured to, and extends transversely between, the outer ends of a pair of metal straps 57, the inner ends of which are pivotally connected by screws 58 (FIG. 2) to diametrally opposite sides of the shroud 35 adjacent its upper end.

Figure 4:
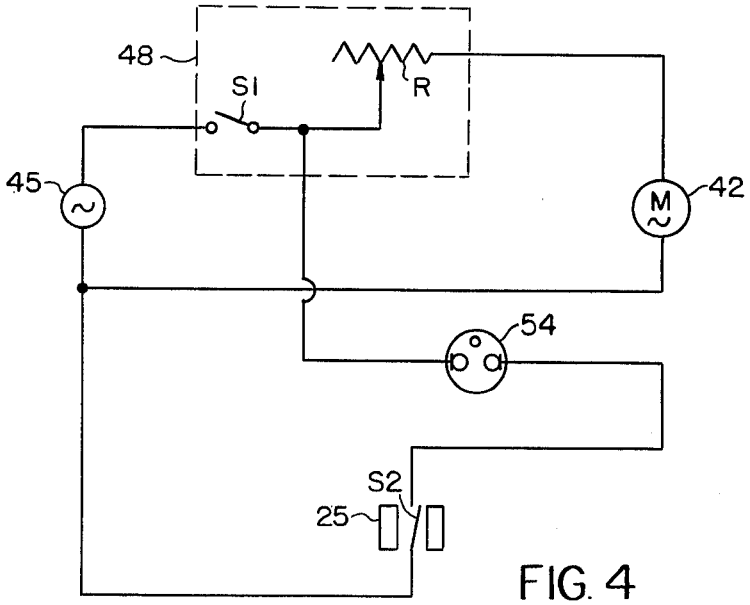
FIG. 4 is a schematic wiring diagram illustrating one manner in which the humidifier can be wired for operation.

As shown in FIG. 4, when the cord 45 is connected to an AC power supply voltage is applied across a circuit in which the ON-OFF switch S1 and rheostat R of unit 48 are connected in series with the motor 42. As a consequence, whenever the knob 50 is rotated in one direction it will close the normally-opened switch S1 to supply power to the motor 42, and upon further rotation will adjust the rheostat R to effect a corresponding adjustment in the speed of rotation of the fan 44. To shut off the motor 42 the knob 50 is simply rotated back to its start position once again to reopen switch S1 and to deenergize the motor 42.

Also as shown in FIG. 4, the cord 45 is adapted to apply an AC voltage across another circuit which is connected in series with the switch S1, and in parallel with the rheostat R and the motor winding for the motor 42. In this second circuit the reed switch S2, which is contained in the float stem 24, is connected in series with the neon warning bulb or lamp 54 and the ON-OFF switch S1, which forms part of the unit 48. Switch S2 is normally closed by the float 25 whenever there is a sufficient quantity of water W in the tank 10. However, whenever the float 25 falls downwardly on the stem 24 to the lowermost position, as for example when the water level in the tank 10 becomes too low, the switch S2 will close in order to energize the warning lamp 54, thereby indicating that it is time to add water to the tank 10.

In use, the tank 10 is filled with water to the desired level, and the entire unit is conveyed by its handle 56 and placed upon the top of a stove, or the like, so that heat from the stove will tend to warm the water in the tank 10, thus creating a vapor which is discharged through the ports 36 completely around the outside of the lower end of shroud 35. The knob 50 is then rotated to close switch S1 and to adjust the rheostat R to rotate the fan 44 at the desired speed. The rotating fan 44 creates a low pressure area adjacent its upper end, thereby drawing atmospheric air downwardly into the shroud through its ports 52 as indicated by the arrows in FIG. 1. This air is then blown radially out of the bottom of the shroud 35 around its circumferential edge entraining as it does the vapor which is being discharged out of the ports 36. The rate at which moisture is discharged into the room will thus depend upon the speed of fan 44 and the rate at which water is vaporized in the tank 10. If the tank is placed on a heated surface, obviously the amount of vapor discharged through ports 36 will be substantially greater than would be the amount discharged if the tank 10 were to be placed on an unheated or cooler surface.

From the foregoing it will be apparent that the present invention provides a relatively simple and inexpensive means for humidifying the air in a room or home which might otherwise be so low in vapor content as to cause extreme discomfort to the residents. The rotation of fan 44 can be controlled merely by adjustment of the knob 50, while the warning lamp 54 provides ready, visual means for indicating when the water content of the tank 10 should be increased. Also, it will be noted that the gently sloped top of tank 10 is configured in such manner that the air blown downwardly and out of the lower end of the shroud 35 is caused to be discharged generally radially outwardly, and somewhat downwardly relative to the tank, so that most efficient use will be made of the moist air which is circulated by the unit. Furthermore, the fan 44 is mounted above the upper end of the tank 10 and within the shroud 35, so that the fan motor 42 is protected from any direct exposure to any heated surface upon which the tank 10 might be mounted. This helps to prolong the life of motor 42 and fan 44. Likewise the manually operable knob 50 and switch unit 48 are mounted above and to the exterior shroud 35, so that they also are sheltered from any heat which might be generated beneath the tank 10.

While this invention has been illustrated and described in detail in connection with only one embodiment thereof, it will be apparent that it is capable of still further modification and that this application is intended to cover any such modifications as may fall within the scope of one skilled in the art or the appended claims.

Having thus described my invention, what I claim is:

1. A humidifier, comprising a water tank having a substantially closed upper end which has therein a plurality of spaced vapor ports, an inverted, generally cup-shaped shroud mounted on said tank centrally thereof, and with its lower, open end spaced above the upper end of said tank, an electric fan mounted to rotate in said shroud coaxially thereof, and in spaced, confronting relation to said upper end of said tank, and means for connecting said fan to an electrical power supply for operation thereby, said shroud having in its upper end a plurality of vent openings, whereby upon energization of the fan air is drawn by the fan inwardly through said vent openings, and is discharged radially outwardly through the lower end of said shroud and across said vapor ports to entrain moisture therefrom, said tank having an outside diameter larger than that of said shroud, and said vapor ports being positioned so that at least portions thereof extend radially outwardly beyond and relative to said lower end of the shroud.

2. A humidifier comprising a water tank having a plurality of vapor ports in its upper end, an inverted, generally cup-shaped shroud mounted on said tank centrally thereof, and with its lower, open end spaced above the upper end of said tank, an electric fan mounted to rotate in said shroud coaxially thereof, and in spaced, confronting relation to said upper end of said tank, means for connecting said fan to an electrical power supply for operation thereby, said shroud having in its upper end a plurality of vent openings, whereby upon energization of the fan air is drawn by the fan inwardly through said vent openings, and is discharged radially outwardly through the lower end of said shroud and across said vapor ports to entrain moisture therefrom, and said tank having an outside diameter larger than that of said shroud, and said vapor ports being arranged in a circle adjacent the lower, open end of said shroud.

3. A humidifier as defined in claim 2, wherein the diameter of the circle in which said vapor ports are arranged is larger than the outside diameter of said shroud whereby at least portions of each of said vapor ports are positioned radially outwardly of said shroud.

4. A humidifier as defined in claim 1, including means for sensing the level of water in said tank, and a warning lamp on said tank disposed to be energized automatically by said sensing means when the level of the water in said tank falls below a predetermined level.

5. A humidifier as defined in claim 4, wherein said sensing means comprises a first switch housing projecting downwardly into said tank from the upper end thereof, a float mounted to slide verically on said housing in response to changes in the level of the water in said tank, and a switch in said housing electrically connected in series with said lamp and disposed to be closed by said float when said level of the water falls below said predetermined level.

6. A humidifier as defined in claim 5, wherein said first switch housing is secured to and projects downwardly from a cover which is removably secured over a central opening in the top of said tank, whereby said switch housing and float are removable from said tank with said cover.

7. A humidifier as defined in claim 5, including an electric motor mounted in said shroud to drive said fan, and switch means connected to said motor and operable manually from the exterior of said shroud to control the rate of rotation of said fan, said lamp being connected in parallel with said motor and in series with said switch means.

8. A humidifier as defined in claim 7, including means releasably mounting said motor at one end on the underside of the upper, closed end of said shroud, and with the armature of the motor projecting centrally downwardly in said shroud and having the fan fixed thereto for rotation in a plane extending normal to the axis of said shaft and axially spaced inwardly from the lower, open end of said shroud.

9. A humidifier as defined in claim 7, including a second switch housing secured to the exterior of said shroud centrally of its upper end, and said switch means including a knob mounted for manual rotation on said second switch housing and operatively connected to said motor to control the rotation of said fan.

10. A humidifier as defined in claim 9, including a handle pivotally connected at one end to said shroud and manually engageable at its opposite end for carrying the humidifier.

11. A humidifier as defined in claim 10, including an electric cord secured intermediate its ends in the side of said shroud and operable to supply power to said motor, and a coiled spring surrounding a portion of said cord adjacent the exterior of said shroud and operable to support said portion of the cord transverse to said side of the shroud.

12. A humidifier comprising a water tank having a plurality of vapor ports in its upper end, an inverted, generally cup-shaped shroud mounted on said tank centrally thereof, and with its lower, open end spaced above the upper end of said tank, an electric fan mounted to rotate in said shroud coaxially thereof, and in spaced, confronting relation to said upper end of said tank means for connecting said fan to an electrical power supply for operation thereby, said shroud having in its upper end a plurality of vent openings, whereby upon energization of the fan air is drawn by the fan inwardly through said vent openings, and is discharged radially outwardly through the lower end of said shroud and across said vapor ports to entrain moisture therefrom, and said tank comprising an inverted, generally cup-shaped, sheetmetal shell closed at its lower end by a circular plate the marginal edge of which is secured by a rolled, double seamed joint to the lower end of said shell, and the upper end of said shell being bowed slightly upwardly at its center thereby to cause air from the rotating fan to be directed radially outwardly and downwardly of the shell.

13. A humidifier as defined in claim 1, wherein the upper end of said tank is bowed slightly upwardly at its center thereby to cause air from said fan to be directed radially outwardly and downwardly of said tank and across said vapor ports.

14. A humidifier as defined in claim 1, wherein at least certain of said vapor ports are arranged in a circle the diameter of which is greater than the lower end of said shroud.

* * * * *